US008598861B2

(12) United States Patent
Teh

(10) Patent No.: US 8,598,861 B2
(45) Date of Patent: Dec. 3, 2013

(54) CIRCUIT AND METHOD FOR PROVIDING A REFERENCE SIGNAL

(75) Inventor: Cheng Hwa Teh, The Riverdale (SG)

(73) Assignee: O2Micro Inc., Santa Clara, CA (US)

( * ) Notice: Subject to any disclaimer, the term of this patent is extended or adjusted under 35 U.S.C. 154(b) by 126 days.

(21) Appl. No.: 13/329,520

(22) Filed: Dec. 19, 2011

(65) Prior Publication Data

US 2013/0154592 A1 Jun. 20, 2013

(51) Int. Cl.
*G05F 3/20* (2006.01)

(52) U.S. Cl.
USPC ..... 323/313

(58) Field of Classification Search
USPC ..... 323/265, 280, 282, 299, 312, 313, 351
See application file for complete search history.

(56) References Cited

U.S. PATENT DOCUMENTS

| | | | | |
|---|---|---|---|---|
| RE41,061 | E * | 12/2009 | Zinn | 323/266 |
| 7,863,875 | B1 * | 1/2011 | Guo et al. | 323/275 |
| 7,868,603 | B2 * | 1/2011 | Lacombe et al. | 323/285 |
| 8,233,256 | B2 * | 7/2012 | Mehas et al. | 361/93.2 |
| 2010/0327828 | A1 * | 12/2010 | Lee et al. | 323/273 |
| 2012/0257312 | A1 * | 10/2012 | Mehas et al. | 361/18 |

* cited by examiner

*Primary Examiner* — Adolf Berhane
(74) *Attorney, Agent, or Firm* — Pillsbury Winthrop Shaw Pittman LLP

(57) ABSTRACT

An integrated circuit for providing a reference signal to a regulator includes a comparison circuit and a first reference signal adjustor. The comparison circuit is configured to output a control signal based on a difference between levels of a constraint signal of the regulator, such as an input voltage signal or a supply voltage signal, and the reference signal. The regulator has a feedback control loop maintained by the reference signal. The first reference signal adjustor is operatively coupled to the comparison circuit and is configured to adjust the level of the reference signal based on the control signal such that the level of the reference signal increases toward a preset level and does not cause the feedback control loop of the regulator to become saturated when the regulator is in a start-up phase.

23 Claims, 13 Drawing Sheets

CIRCUIT AND METHOD FOR PROVIDING A REFERENCE SIGNAL

BACKGROUND

The disclosure relates generally to a circuit and method for providing a reference signal to a regulator.

A regulator in electronic devices is designed to automatically maintain a constant level of an output signal, e.g., a voltage or current signal, by a feed-forward design or a negative feedback control loop. FIG. 1 shows a typical linear voltage regulator 100. In this example, a feedback control loop, which is formed by an error amplifier 102 and a transistor (pass element) 104, with sufficient gain may regulate the feedback voltage $V_{fb}$ toward a fixed or externally preset reference voltage $V_{ref}$ at the non-inverting node of the error amplifier 102. The error amplifier 102 drives the transistor 104 with more current if the voltage at its inverting node drops below the reference voltage signal $V_{ref}$. Using a voltage divider 106, 108 allows choice of an arbitrary output voltage level $V_{out}$ between levels of the reference voltage $V_{ref}$ and input voltage $V_{in}$. During the start-up phase of the voltage regulator 100, a fixed slew-rate reference signal generator 110 is typically employed for slowly ramping-up the reference voltage signal $V_{ref}$ in a controlled manner toward a preset voltage level $V_{set}$ when transiting into the steady-state phase. In the start-up phase, the first switch 112 of the reference signal generator 110 is turned on while the second switch 114 is turned off such that the current source 116 continues charging the capacitor 118 by applying a constant charging current signal $I_c$. The slew-rate of the reference voltage signal $V_{ref}$ at one end of the capacitor 118 is then fixed at a value determined by the charging current $I_c$ and the capacitor 118. In the steady-state phase, the first switch 112 is turned off while the second switch 114 is turned on such that the reference voltage signal $V_{ref}$ is maintained at the preset voltage level $V_{set}$.

In an ideal situation, with control of the slew-rate of the reference voltage signal $V_{ref}$ within the control loop bandwidth of the voltage regulator 100, the feedback voltage $V_{fb}$, and eventually the output voltage $V_{out}$, will follow the reference voltage $V_{ref}$ and rise toward the preset voltage level $V_{set}$ with minimal or no overshoot. However, in the event that the slew-rate of either the input voltage signal $V_{in}$ or supply voltage (bias) signal $V_{dda}$ of the voltage regulator 100 is slower than the slew-rate required for proper regulation of the output voltage $V_{out}$ to follow the reference voltage signal $V_{ref}$, as shown in FIGS. 2A and 2B, the output voltage $V_{out}$ constrained by the input voltage signal $V_{in}$ or the supply voltage signal $V_{dda}$ may not be regulated by the reference voltage signal $V_{ref}$ and the feedback control loop of the voltage regulator 100 will become saturated. For example, in FIG. 2A, the output voltage $V_{out}$ is not regulated to follow the reference voltage signal $V_{ref}$ due to the constraint imposed by the input voltage signal $V_{in}$. In FIG. 2B, the output voltage $V_{out}$ is not regulated to follow the reference voltage signal $V_{ref}$ due to insufficient headroom (too low $V_{dda}$) for error amplifier 102 to regulate the output voltage $V_{out}$. The proper regulation of the output voltage $V_{out}$ may require (1) the input voltage signal $V_{in}$ is larger than the output voltage $V_{out}$($V_{in}$>$V_{out}$) and (2) the supply voltage signal $V_{dda}$ is larger than the output voltage $V_{out}$ plus the headroom voltage of the error amplifier 102 ($V_{dda}$>$V_{out}$+$V_{headroom}$). When the input voltage signal $V_{in}$ in FIG. 2A or the supply voltage signal $V_{dda}$ in FIG. 2B eventually exceeds the level required for proper regulation of the output voltage $V_{out}$ toward the preset voltage level $V_{set}$, the feedback control loop of the voltage regulator 100 will try to regain regulation. However, during this process, an overshoot may occur when the output voltage signal $V_{out}$ exceeds the preset voltage level $V_{set}$ for a transient period, as shown in FIGS. 2A and 2B, which is undesirable for devices that are sensitive to overshooting, like processor. During this transient, the feedback control loop of the voltage regulator 100 exits from saturation state and attempts to enter into regulation state. It is understood that although a voltage regulator 100 is shown in FIG. 1, the same overshooting problem may also occur for a current regulator where an output current signal is regulated by a feedback control loop maintained by a reference voltage signal if the slew-rate of the reference voltage signal is faster than that of the input voltage signal or supply voltage signal of the current regulator in its start-up phase.

Known solutions to solve the overshooting problem include (1) designing the slew-rate of the reference signal to be slower than that of the input signal and (2) applying an external capacitor based on the known slew-rate of the input signal. For the former solution, it typically requires more silicon area to achieve a slower slew-rate for the reference signal and may encounter a practical limitation on the lowest slew-rate that can be implemented. As to the latter solution, it is costly as it uses an extra external capacitor and I/O pin. Further, if the slew-rate of the input signal is slower than its recommended value based on a chosen capacitor, an overshoot may still occur for the latter solution. Moreover, neither solution can be applied if the input signal of the regulator has a wide varying rise-time.

Accordingly, there exists a need for an improved circuit and method for providing a reference signal to a regulator.

BRIEF DESCRIPTION OF THE DRAWINGS

The embodiments will be more readily understood in view of the following description when accompanied by the below figures and wherein like reference numerals represent like elements, wherein.

SUMMARY

Figure 1:
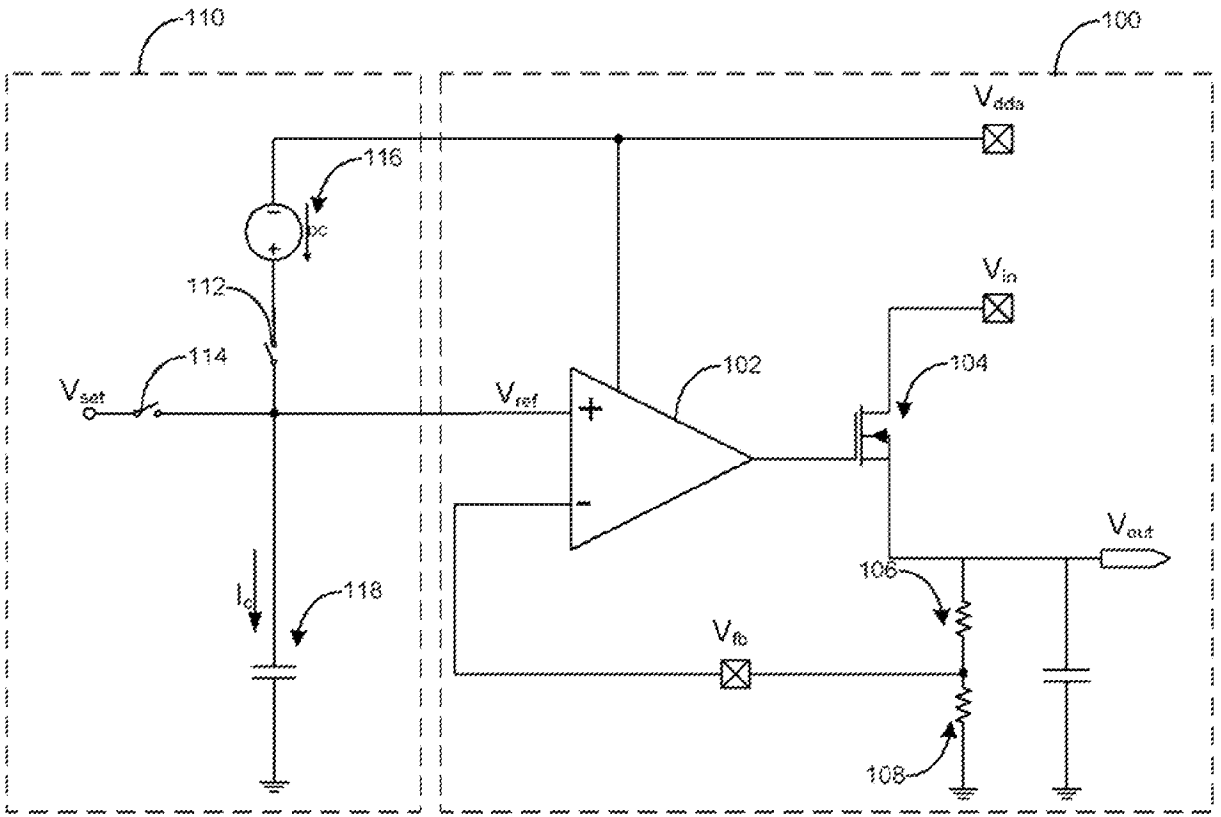
FIG. 1 PRIOR ART
FIG. 1 is a circuit diagram illustrating a voltage regulator and a fixed slew-rate reference signal generator.

The present disclosure describes a circuit and method for providing a reference signal to a regulator. In one example, an integrated circuit for providing a reference signal to a regulator is provided. The integrated circuit includes a comparison circuit and a first reference signal adjustor. The comparison circuit is configured to output a control signal based on a difference between levels of a constraint signal of the regulator, such as an input voltage signal or a supply voltage signal, and the reference signal. The regulator has a feedback control loop maintained by the reference signal. The first reference signal adjustor is operatively coupled to the comparison circuit and is configured to adjust the level of the reference signal based on the control signal such that the level of the reference signal increases toward a preset level and does not cause the feedback control loop of the regulator to become saturated when the regulator is in a start-up phase.

In another example, an apparatus including an adaptive reference signal generator is provided. The apparatus further includes a regulator, a circuit, and a power source. The regulator is configured to provide an output signal and regulate the output signal at a certain level. The regulator has a feedback control loop maintained by a reference signal. The circuit is operatively coupled to the regulator and is configured to receive the output signal and perform one or more functions based on the output signal at the certain level. The power source is operatively coupled to the regulator and is configured to provide a constraint signal, such as an input voltage signal or a supply voltage signal, to the regulator. The adaptive reference signal generator is operatively coupled to the regulator and is configured to generate the reference signal based on the constraint signal.

In still another example, a method for providing a reference signal to a regulator is provided. A constraint signal of a regulator, such as an input voltage signal or a supply voltage signal, is first received. The regulator has a feedback control loop maintained by the reference signal. A control signal is then outputted based on a difference between levels of the constraint signal and the reference signal. Based on the control signal, the level of the reference signal is adjusted such that the level of the reference signal increases toward a preset level and does not cause the feedback control loop of the regulator to become saturated when the regulator is in a start-up phase.

In yet another example, a computer readable medium storing instructions executable by one or more integrated circuit design systems that causes the one or more integrated circuit design systems to design an integrated circuit is provide. The designed integrated circuit includes a comparison circuit and a first reference signal adjustor. The comparison circuit is configured to output a control signal based on a difference between levels of a constraint signal of a regulator, such as an input voltage signal or a supply voltage signal, and a reference signal. The regulator has a feedback control loop maintained by the reference signal. The first reference signal adjustor is operatively coupled to the comparison circuit and is configured to adjust the level of the reference signal based on the control signal such that the level of the reference signal increases toward a preset level and does not cause the feedback control loop of the regulator to become saturated when the regulator is in a start-up phase.

DETAILED DESCRIPTION

Reference will now be made in detail to the embodiments of the present disclosure, examples of which are illustrated in the accompanying drawings. While the present disclosure will be described in conjunction with the embodiments, it will be understood that they are not intended to limit the present disclosure to these embodiments. On the contrary, the present disclosure is intended to cover alternatives, modifications, and equivalents, which may be included within the spirit and scope of the present disclosure as defined by the appended claims.

Furthermore, in the following detailed description of embodiments of the present disclosure, numerous specific details are set forth in order to provide a thorough understanding of the present disclosure. However, it will be recognized by one of ordinary skill in the art that the present disclosure may be practiced without these specific details. In other instances, well-known methods, procedures, components, and circuits have not been described in detail as not to unnecessarily obscure aspects of the embodiments of the present disclosure.

Embodiments in accordance with the present disclosure provide a circuit and method for providing a reference signal to a regulator, such as a voltage regulator or a current regulator. Compared with the fixed or externally preset reference signal shown in FIG. 1, the adaptive reference signal in the present disclosure ensures that the slew-rate of the reference signal is within the feedback control loop bandwidth of the regulator, thereby avoiding an overshoot at the end of the start-up phase even when the input voltage signal or supply voltage signal of the regulator has a relatively slow slew-rate. Moreover, the reference signal is generated in an adaptive manner to accommodate a wide varying rise-time of the input voltage signal or supply voltage signal, e.g., from about 1 ms to about 10 ms, without the need of extra external components or silicon area. Additional advantages and novel features will be set forth in part in the description which follows, and in part will become apparent to those skilled in the art upon examination of the following and the accompanying drawings or may be learned by production or operation of the examples.

Figure 3:
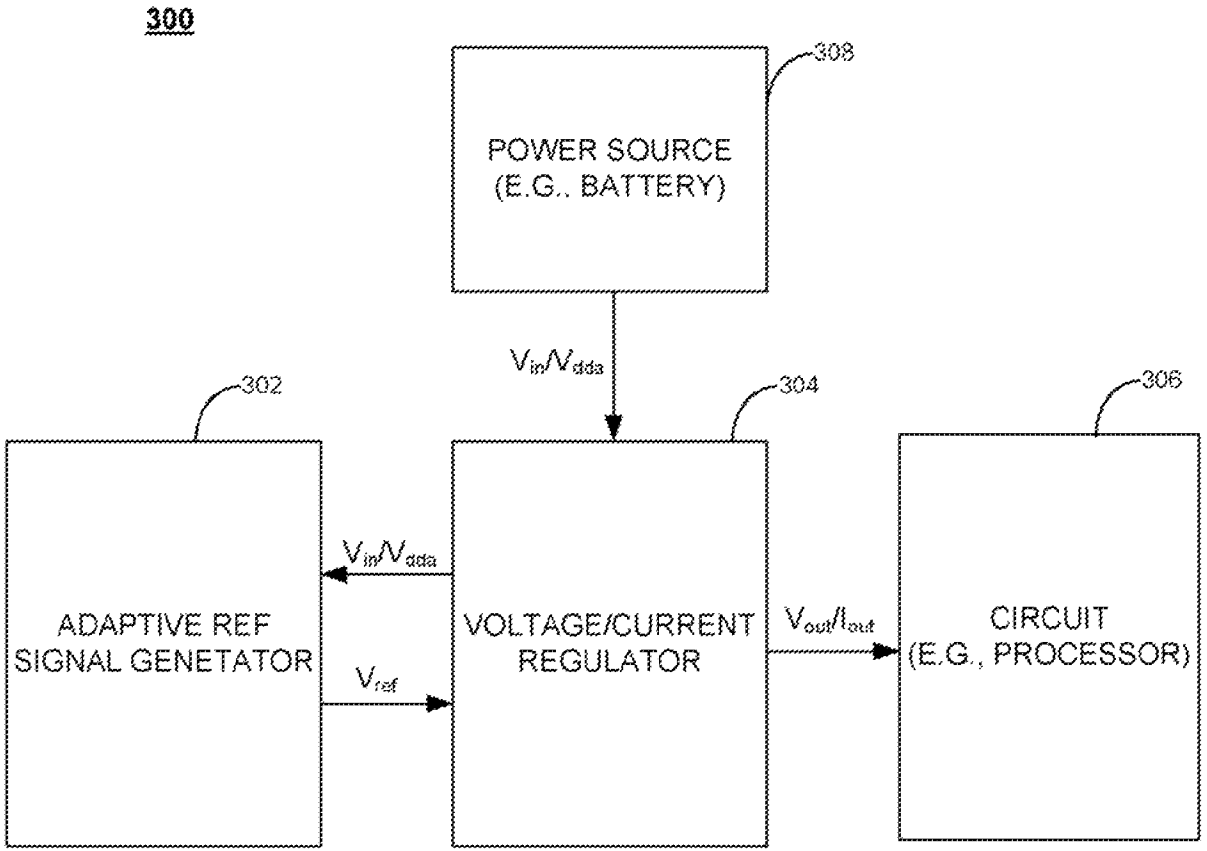
FIG. 3 is a block diagram illustrating an example of an apparatus including an adaptive reference signal generator, in accordance with one embodiment of the present disclosure.

FIG. 3 illustrates an apparatus 300 including an adaptive reference signal generator 302. The apparatus 300 may be any suitable electronic device, such as but is not limited to, a laptop computer, desktop computer, netbook computer, media center, digital camera, digital camcorder, handheld device (e.g., dumb or smart phone, tablet, etc.), gaming console, set-top box, television set, printer, or any other suitable device. The apparatus 300 may further include a regulator 304, a circuit 306, and a power source 308. The regulator 304 may be any suitable voltage regulator or current regulator that has a feedback control loop to maintain its output voltage signal $V_{out}$ or output current signal $I_{out}$ at a certain level. For example, the regulator 304 may be a standard linear voltage regulator, a low drop-out (LDO) linear voltage regulator, a switching voltage regulator, or a transistor-based current regulator. The feedback control loop of the regulator 304 may be maintained (e.g., not be saturated) by receiving a reference signal $V_{ref}$ at a proper level (slew-rate, rise-time) provided by the adaptive reference signal generator 302. The circuit 306 is operatively coupled to the regulator 304 and may be any suitable integrated or discrete circuit that receives the regulated output signal $V_{out}/I_{out}$ from the regulator 304 and performs one or more functions based on the output signal $V_{out}/I_{out}$ at the certain level. In this example, the circuit 306 includes any circuit that is sensitive to overshooting, such as but not limited to, a processor. The "circuit" referred to herein are any suitable circuit that can achieve the desired function, and may be digital circuit, analog circuit, mixed analog-digital circuit, or any suitable circuit. The power source 308 is operatively coupled to the regulator 304 and may be responsible for providing a constraint signal, such as an input voltage signal $V_{in}$ and/or a supply voltage signal $V_{dda}$, to the regulator 304. The constraint signal includes any signal having a slow or varying slew-rate, which limits the ability of regulating the output signal $V_{out}/I_{out}$ to follow the reference signal $V_{ref}$ by the feedback control loop of the regulator 304, such as the input voltage signal $V_{in}$ or the supply voltage signal $V_{dda}$ of the regulator 304. In this example, the power source 308 may be a regulated input power source including a DC power supply, e.g., a battery, a power management unit, e.g., a DC-DC converter, which provides a constraint signal $V_{in}/V_{dda}$ with a slow or varying slew-rate (rise-time). In one example, the constraint signal $V_{in}/V_{dda}$ provided by the power source 308 has a rise-time varying from about 1 ms to about 10 ms. It is understood that in another example, the power source 308 may include an AC power supply and an AC-DC converter.

The adaptive reference signal generator 302 is operatively coupled to the regulator 304 and is configured to generate the reference signal $V_{ref}$ based on the constraint signal $V_{in}/V_{dda}$. For example, the adaptive reference signal generator 302 adjusts the rise-time (slew-rate) of the reference signal $V_{ref}$ to be adaptive to the rise-time (slew-rate) of the constraint signal $V_{in}/V_{dda}$. That is, the adaptive reference signal generator 302 may slow down the ramping-up of the reference signal $V_{ref}$ to follow the slew-rate of the constraint signal $V_{in}/V_{dda}$ while maintaining a maximum slew-rate by a feedback control loop to avoid overshooting. The apparatus 300 may include any other suitable components, including, for example, a display, one or more storages, a communication platform, a sensing module, any other suitable I/O modules, etc.

Figure 4:
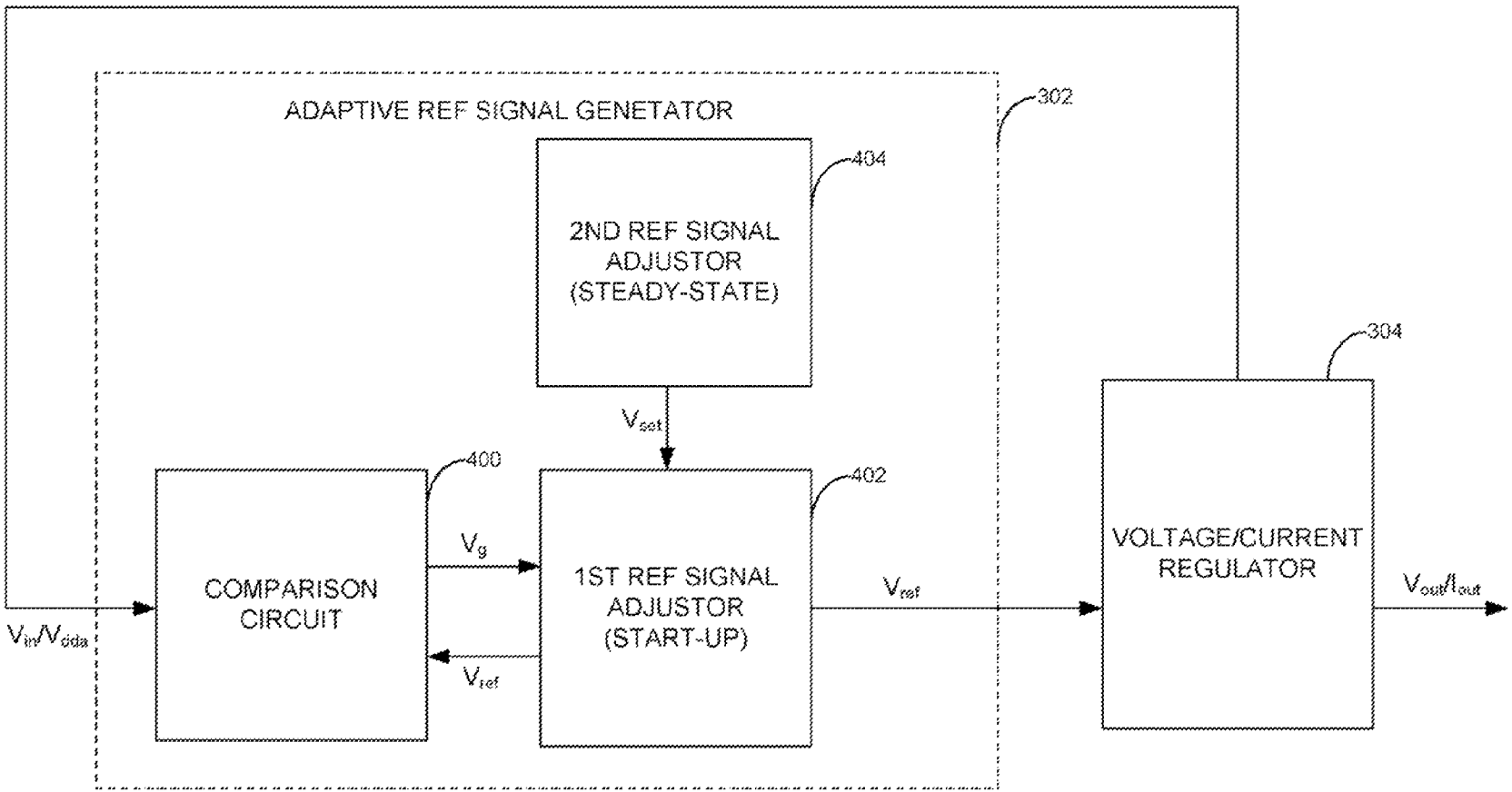
FIG. 4 is a block diagram illustrating an example of an adaptive reference signal generator, in accordance with one embodiment of the present disclosure.

FIG. 4 illustrates one example of the adaptive reference signal generator 302 of the apparatus 300 shown in FIG. 3. The adaptive reference signal generator 302 may be an integrated circuit including a comparison circuit 400 and a first reference signal adjustor 402 operatively coupled to each other. The comparison circuit 400 is configured to output a control signal $V_g$ based on a difference between levels of the constraint signal $V_{in}/V_{dda}$ of the regulator 304 and the reference signal $V_{ref}$. For example, the level difference between the input voltage signal $V_{in}$ or an adjusted supply voltage signal $V_{dda}$ and the reference signal $V_{ref}$ is compared by the comparison circuit 400 and is used for determining the control signal $V_g$. The first reference signal adjustor 402 is configured to adjust the level of the reference signal $V_{ref}$ based on the control signal $V_g$ such that the level of the reference signal $V_{ref}$ increases toward a preset level $V_{set}$ and does not cause the feedback control loop of the regulator 304 to become saturated when the regulator 304 is in a start-up phase. In one example, when the constraint signal is the input voltage signal $V_{in}$, the level of the reference signal $V_{ref}$ is adjusted such that it does not exceed the level of the input voltage signal $V_{in}$. In another example, when the constraint signal is the supply voltage signal $V_{dda}$, the level of the reference signal $V_{ref}$ is adjusted such that it does not exceed an adjusted supply voltage signal level where the feedback control loop of the regulator 304 has insufficient headroom to regulate the output signal $V_{out}/I_{out}$ and becomes saturated. The control signal $V_g$ from the comparison circuit 400, which tracks the difference between the reference signal $V_{ref}$ and constraint signal $V_{in}/V_{dda}$, adjusts and slows down the slew-rate of the reference signal $V_{ref}$ once the reference signal $V_{ref}$ approaches the level of the constraint signal $V_{in}/V_{dda}$. That is, the comparison circuit 400 and the first reference signal adjustor 402 form a feedback control loop to avoid the level of the reference signal $V_{ref}$ to go beyond the level of the constraint signal $V_{in}/V_{dda}$. Thus, the feedback control loop of the regulator 304 may not be saturated during the start-up phase, and the overshoot of the output signal $V_{out}/I_{out}$ at the end of the start-up phase may be avoided.

In this example, the adaptive reference signal generator 302 may further include a second reference signal adjustor 404 operatively coupled to the first reference signal adjustor 402. The second reference signal adjustor 404 may be configured to maintain the reference signal $V_{ref}$ at the preset level $V_{set}$ when the regulator 304 is in a steady-state phase. In other words, the maximum level of the reference signal $V_{ref}$ is limited at the preset level $V_{set}$ and is reached when the regulator 304 turns into the steady-state phase. The transition from the start-up phase to the steady-state phase is smoother compared with known solutions, such as the one shown in FIG. 1, as the slew-rate of the reference signal $V_{ref}$ keeps tracking the slew-rate of the constraint signal $V_{in}/V_{dda}$ during the start-up phase.

Figure 5:
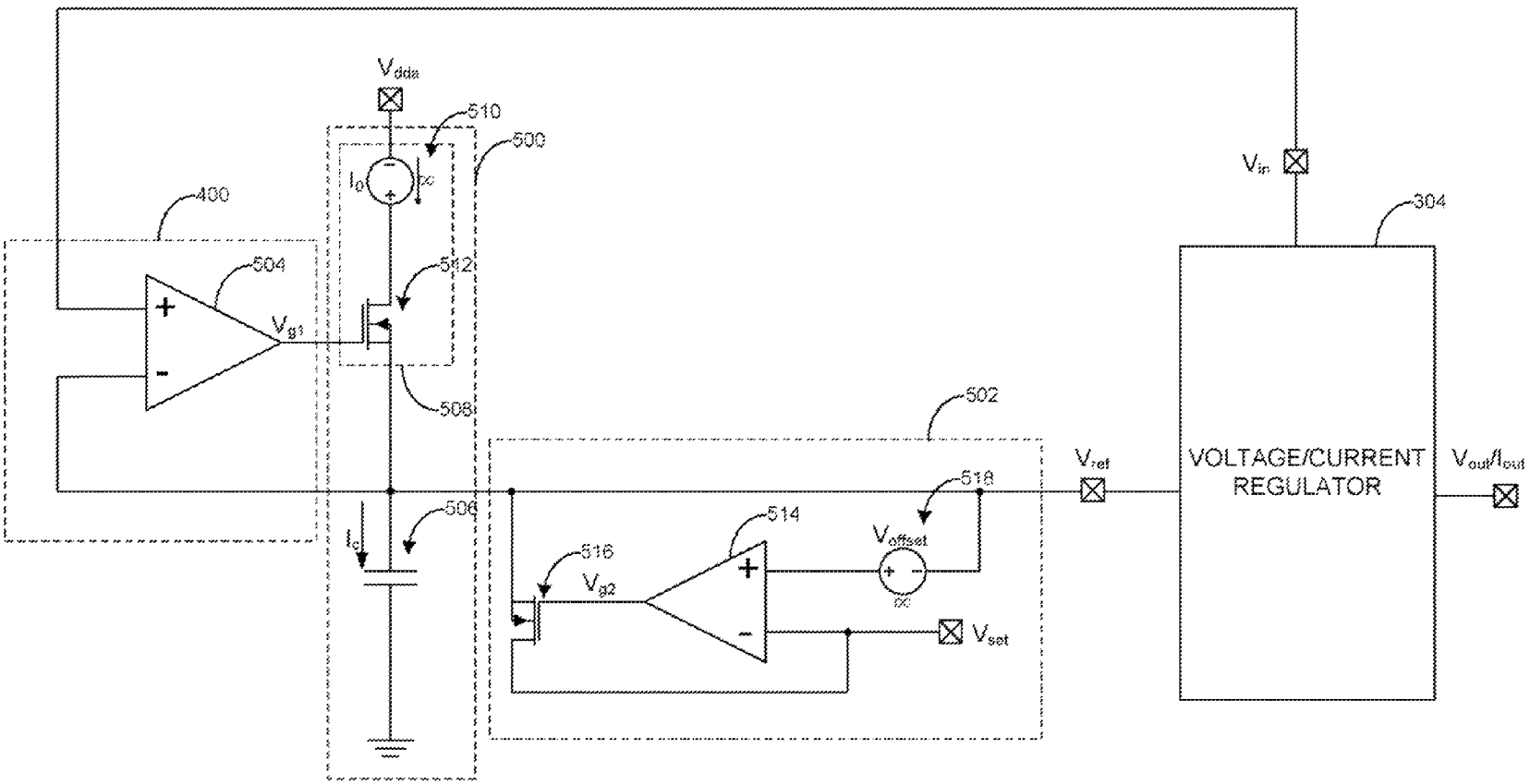
FIG. 5 is a circuit diagram illustrating an example of an adaptive reference signal generator, in accordance with one embodiment of the present disclosure.

FIG. 5 is a circuit diagram illustrating an example of the adaptive reference signal generator 302 shown in FIG. 4, in accordance with one embodiment of the present disclosure. The constraint signal in this example is the input voltage signal $V_{in}$ of the regulator 304. The comparison circuit 400 in this example includes an error amplifier 504. The non-inverting node of the error amplifier 504 receives the input voltage signal $V_{in}$; the inverting node receives the reference signal $V_{ref}$; the output node outputs a control voltage signal $V_{g1}$.

The adaptive reference signal generator 302 in this example includes a first reference signal adjustor 500, which adjusts the slew-rate of the reference signal $V_{ref}$ by adapting a charging current signal for a capacitor 506. The first reference signal adjustor 500 includes the capacitor 506 configured to provide the reference signal $V_{ref}$ at one end as the capacitor 506 is charged by the charging current signal $I_c$. In this example, the capacitance of the capacitor 506 may be from about 10 pF to about 100 pF. It is understood that different capacitance values may be applied and more than one capacitor or any other energy storage element may be applied in other examples. The first reference signal adjustor 500 also includes a charging controller 508 operatively coupled to the capacitor 506. The charging controller 508 is configured to control the slew-rate of the reference signal $V_{ref}$ by adjusting the charging of the capacitor 506 based on the control signal $V_{g1}$ from the comparison circuit 400. In this example, the charging controller 508 includes a current source 510 configured to generate a constant current signal $I_0$ and a transistor 512, e.g., an n-channel MOSFET, operatively coupled to the comparison circuit 400, current source 510, and capacitor 506. In this example, for an input voltage signal $V_{in}$ with a slew-rate from about 1 ms to about 10 ms and a capacitor 506 with a capacitance from about 10 pF to about 100 pF, the constant current signal $I_0$ may be in the range of tens or hundreds of nA, depending on the preset voltage level $V_{set}$.

In this example, the transistor 512 acts as a switch between the current source 510 and the capacitor 506 to adjust the charging current signal $I_c$ based on the control signal $V_{g1}$. The gate of the transistor 512 is connected to the output node of the error amplifier 504 such that the control signal $V_{g1}$ controls the gate voltage of the transistor 512. If the level of the reference signal $V_{ref}$ does not exceed the level of the input voltage signal $V_{in}$ at the non-inverting node of the error amplifier 504, the control signal $V_{g1}$ (gate voltage of the transistor 512) causes the transistor 512 to operate in the linear mode such that the level of the charging current signal $I_c$ applied to the capacitor 506 is substantially equal to the level of the constant current signal $I_0$. The reference signal $V_{ref}$ ramps-up at a slew-rate determined by $$\frac{dV_{ref}}{dt} = \frac{I_0}{C},$$

where C is the capacitance of the capacitor 506. If the level of the reference signal $V_{ref}$ exceeds the level of the input voltage signal $V_{in}$, the control signal $V_{g1}$ (gate voltage of the transistor 512) causes the transistor 512 to operate in the saturation mode such that the level of the charging current signal $I_c$ applied to the capacitor 506 is adjusted in accordance with the difference between the levels of the reference signal $V_{ref}$ and input voltage signal $V_{in}$. That is, in this case, the transistor 512 works as a voltage-controlled variable resistor whose resistance is adjusted by the control signal $V_{g1}$, i.e., by the difference between the levels of the reference signal $V_{ref}$ and input voltage signal $V_{in}$. As the resistance of the transistor 512 increases, the charging current signal $I_c$ decreases accordingly and thus, causes the slew-rate of the reference signal $V_{ref}$ to reduce.

Figure 6:
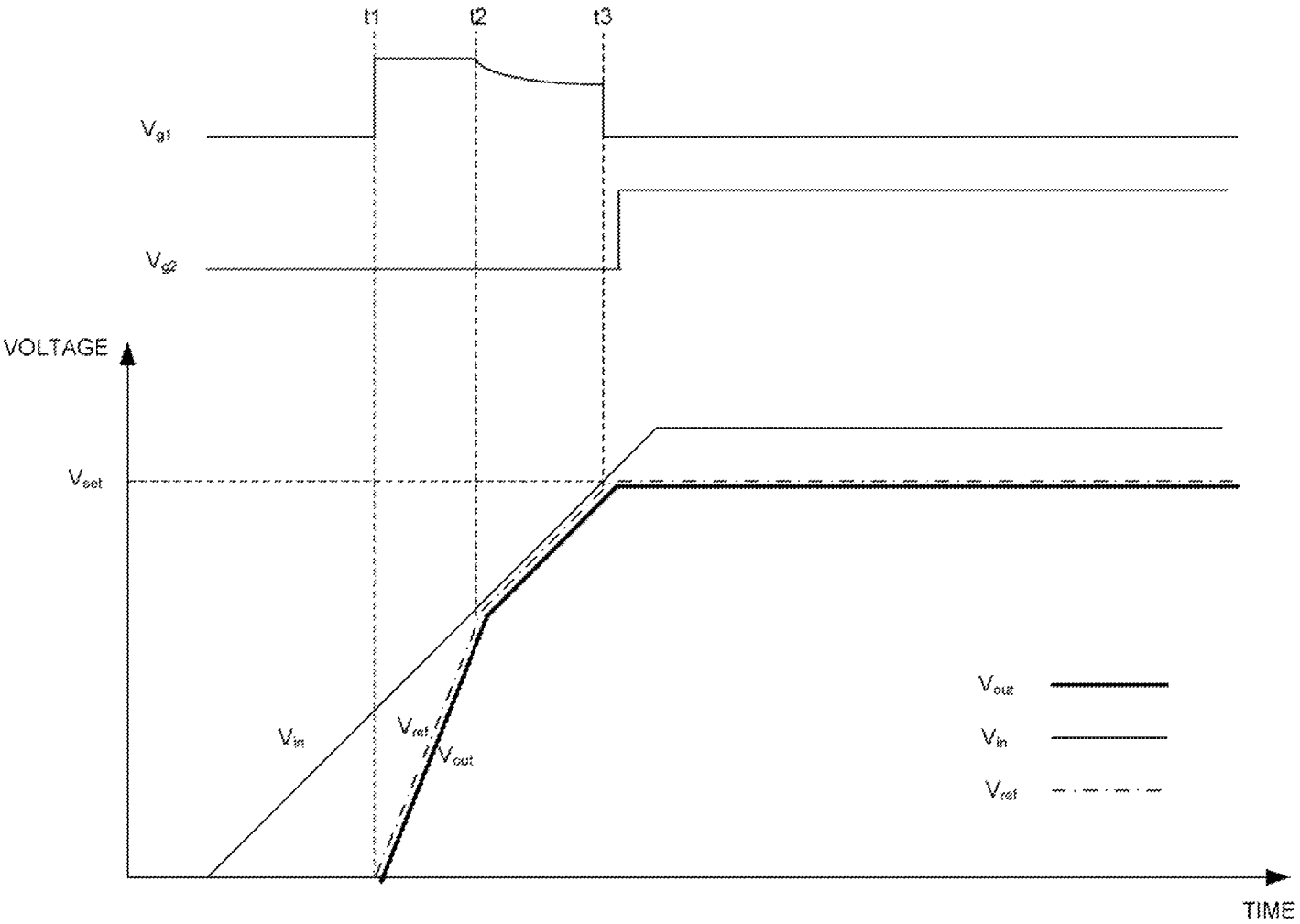
FIG. 6 is a timing diagram for the reference signal, input voltage signal, output signal, and control signals shown in FIG. 5, in accordance with one embodiment of the present disclosure.

Referring now to the timing diagram on FIG. 6, the error amplifier 504 is enabled at time t1. During the time period between t1 and t2, since the input voltage signal $V_{in}$ has a higher voltage level than the reference signal $V_{ref}$, the control signal $V_{g1}$ from the error amplifier 504 (gate voltage of the transistor 512) is kept at logic high. The transistor 512 works at the linear mode between t1 and t2, and the charging current signal $I_c$ is substantially the same as the constant current signal $I_0$. The slew-rate of the reference signal $V_{ref}$ during this time period is $I_0/C$ as noted above, which is higher than the slew-rate of the input voltage signal $V_{in}$. From time t2, since the level of the reference signal $V_{ref}$ catches up with the input voltage signal $V_{in}$, the control signal $V_{g1}$ decreases and the charging current signal $I_c$ reduces accordingly. Thus, the slew-rate of the reference signal $V_{ref}$ is reduced to be substantially the same as that of the input voltage signal $V_{in}$ from t2, as shown in FIG. 6. That is, the feedback control loop formed by the error amplifier 504 and the transistor 512 regulates the slew-rate of the reference signal $V_{ref}$ in accordance with the slew-rate of the input voltage signal $V_{in}$ from t2.

In this example, the adaptive reference signal generator 302 may further include the second reference signal adjustor 502 operatively coupled to the first reference signal adjustor 500. The second reference signal adjustor 502 acts as a switching module configured to turn off the first reference signal adjustor 500 when the level of the reference signal $V_{ref}$ is within an offset range $V_{offset}$ from the preset level $V_{set}$. As shown in FIG. 5, the second reference signal adjustor 502 in this example includes a comparator 514, a voltage source 518 setting up the offset voltage $V_{offset}$, and a transistor 516 connected to the output node of the comparator 514. The comparator 514 compares the levels of reference signal $V_{ref}$ plus offset voltage $V_{offset}$ ($V_{ref}+V_{offset}$) with the preset voltage $V_{set}$ and, immediately or after a certain time period, turns on the transistor 516. As shown in FIG. 6, the transistor 516 is turned on by a control signal $V_{g2}$ outputted from the comparator 514 when $V_{ref}+V_{offset}>V_{set}$. The offset voltage $V_{offset}$ may be introduced as a delay after the reference signal $V_{ref}$ reaches the preset voltage level $V_{set}$. The delay could improve the performance by allowing the reference signal $V_{ref}$ rising closer to the preset voltage $V_{set}$ before closing the transistor 516. At substantially the same time, the adaptive reference signal generator 302 may turn off the first reference signal adjustor 500 by for example, turning off the enable signal applied to the error amplifier 504 or the transistor 512. In other words, when the level of the reference signal $V_{ref}$ approaches the preset level $V_{set}$ with a margin $V_{offset}$, the regulator 304 turns into the steady-state phase, and the reference signal $V_{ref}$ is kept at the preset level $V_{set}$ by the second reference signal adjustor 502, as shown in FIG. 6. In one example, the offset voltage $V_{offset}$ may be in the range of a few mV.

Figure 2A:
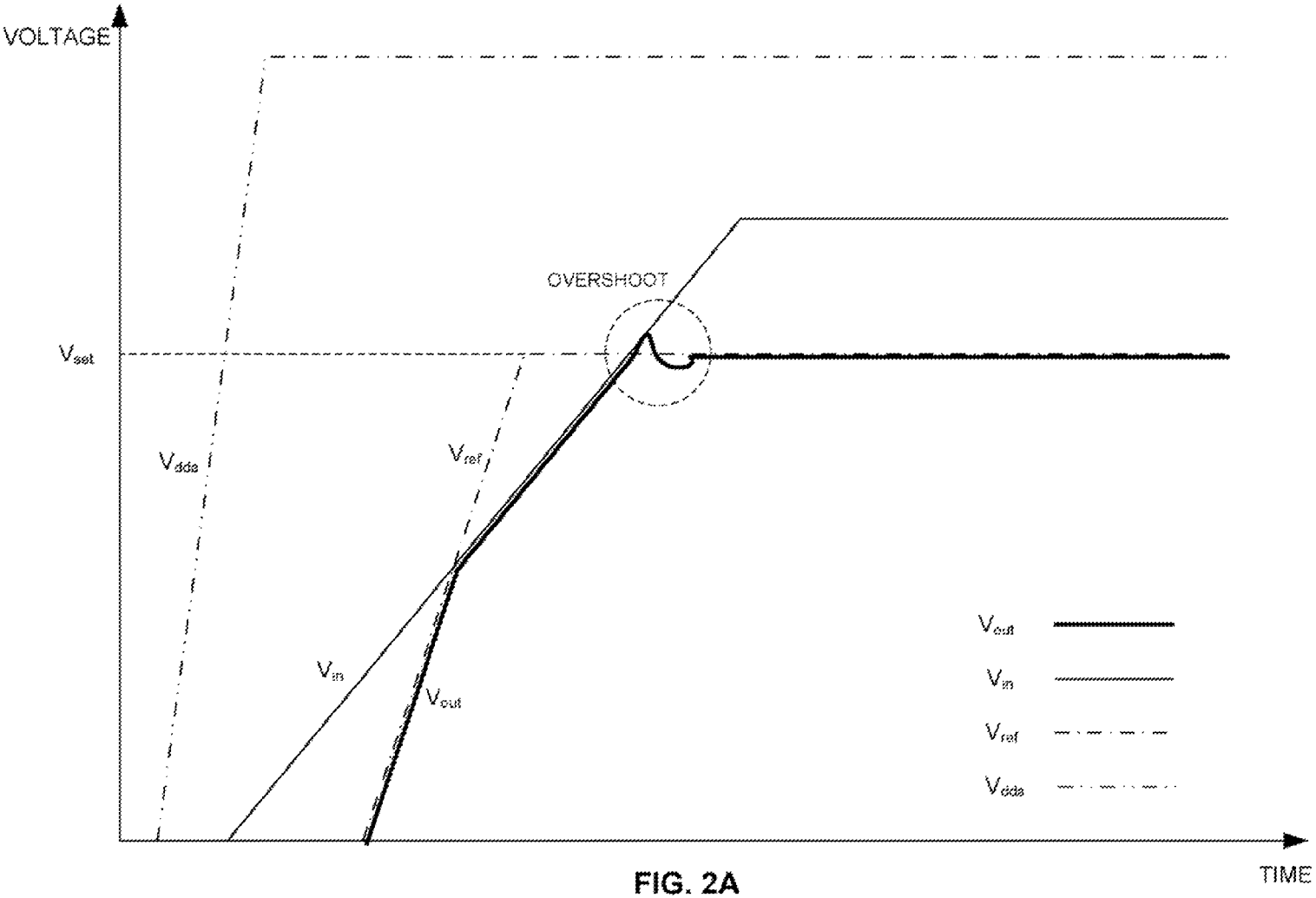
FIG. 2A PRIOR ART
FIGS. 2A and 2B are timing diagrams for the reference signal, input voltage signal, supply voltage signal, and output signal shown in FIG. 1.
Figure 2B:
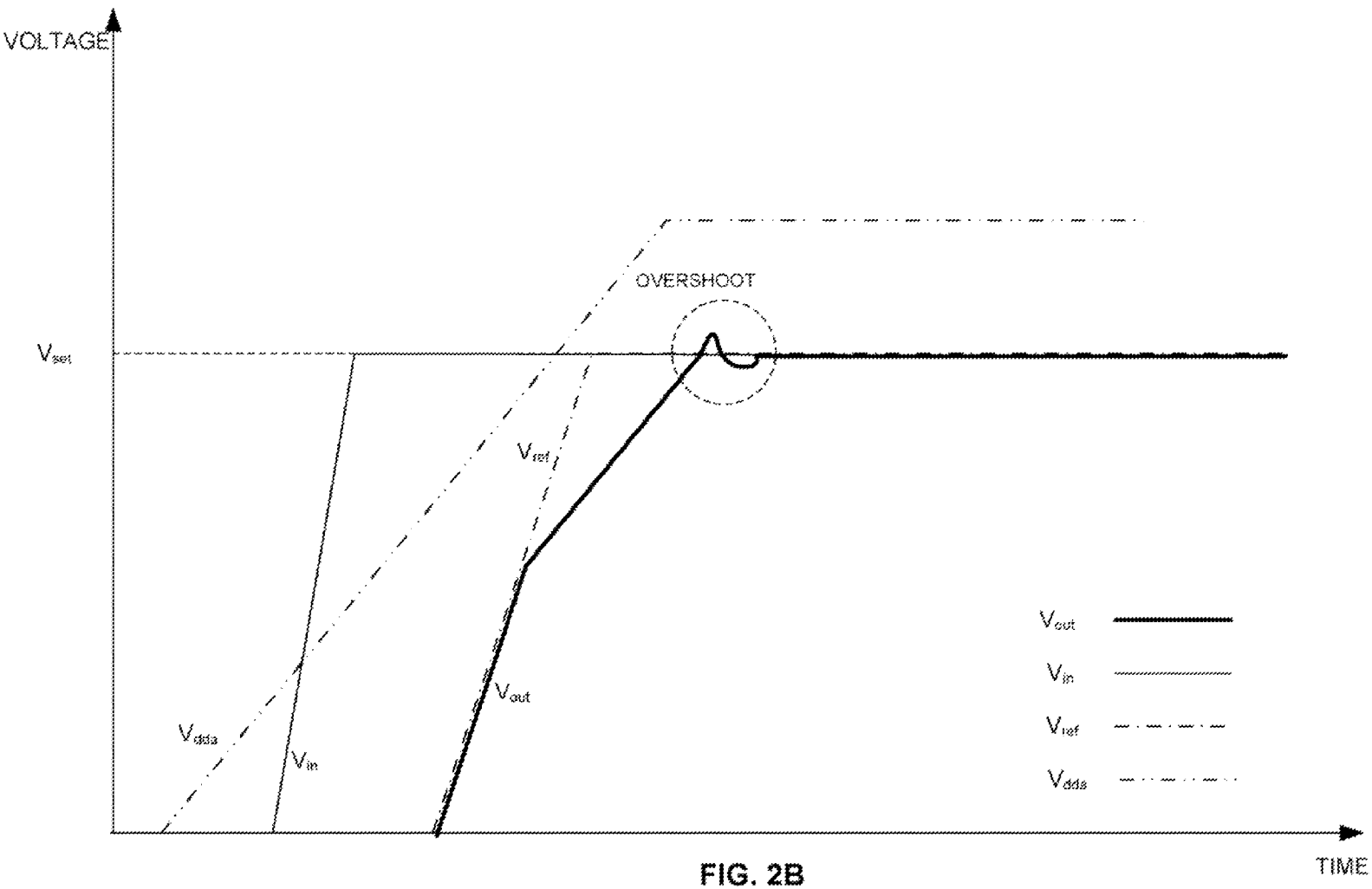
FIG. 2B PRIOR ART

Compared with FIG. 2, as the slew-rate of the reference signal $V_{ref}$ in this example is adaptive to the slew-rate of the input voltage signal $V_{in}$, the difference error voltage of the feedback control loop of the regulator 304 may not be saturated, and thus, the overshoot of the output voltage signal $V_{out}$ of the regulator 304 may be avoided in FIG. 6. Similarly, if the regulator 304 is a current regulator, the overshoot of its output current signal $I_{out}$ may be avoided as well in the same vein.

Figure 7:
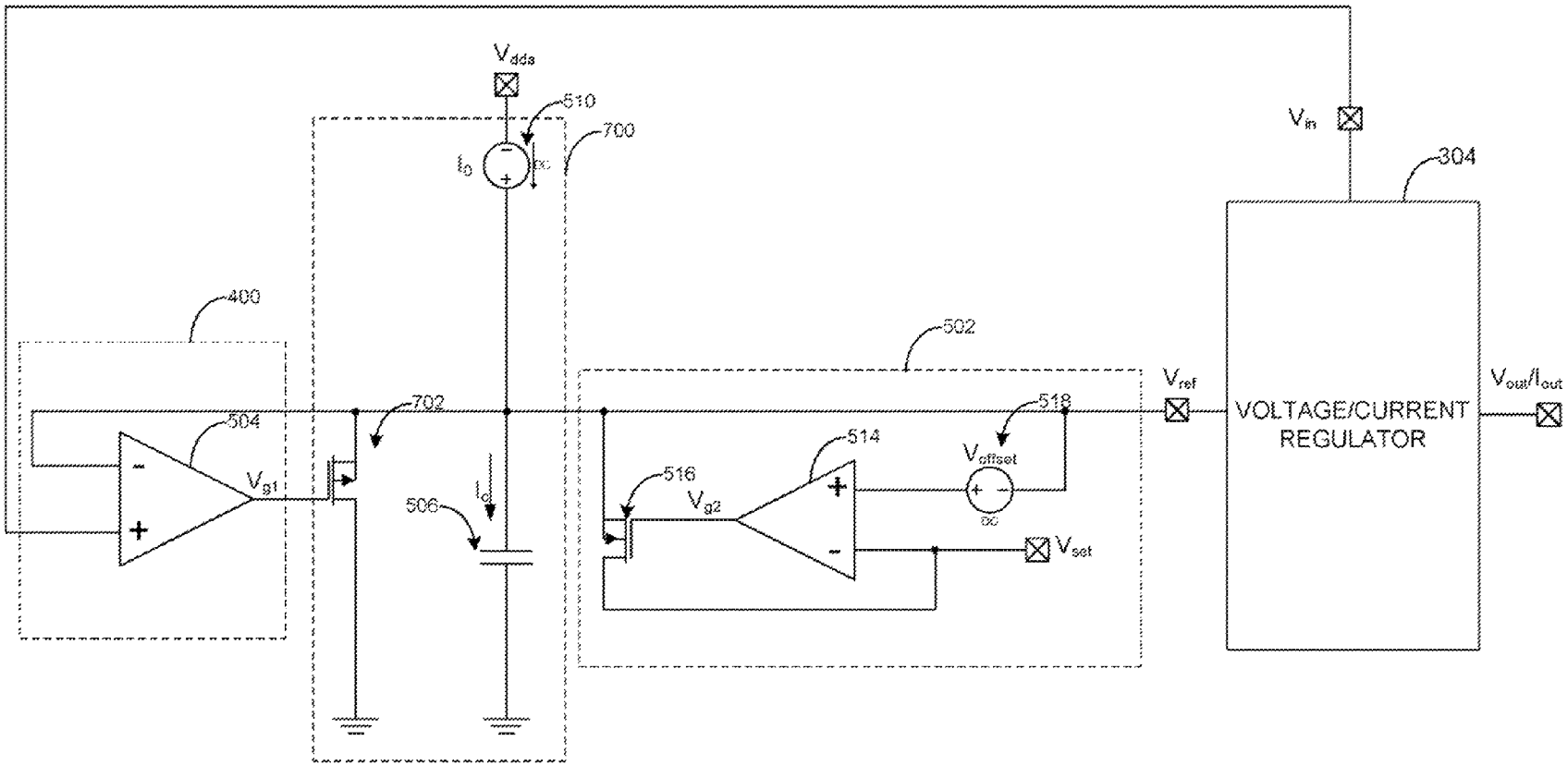
FIG. 7 is a circuit diagram illustrating another example of an adaptive reference signal generator, in accordance with one embodiment of the present disclosure.

FIG. 7 is a circuit diagram illustrating another example of the adaptive reference signal generator 302 shown in FIG. 4, in accordance with one embodiment of the present disclosure. The adaptive reference signal generator 302 has a similar configuration as what is shown in FIG. 5-*except* that the first reference signal adjustor 700 includes a p-type transistor 702, such as a p-channel MOSFET, instead of an n-type transistor. For example, as shown in FIG. 7, when the level of the input voltage signal $V_{in}$ is below the level of the reference signal $V_{ref}$, the charging current signal $I_c$ drops.

Figure 8:
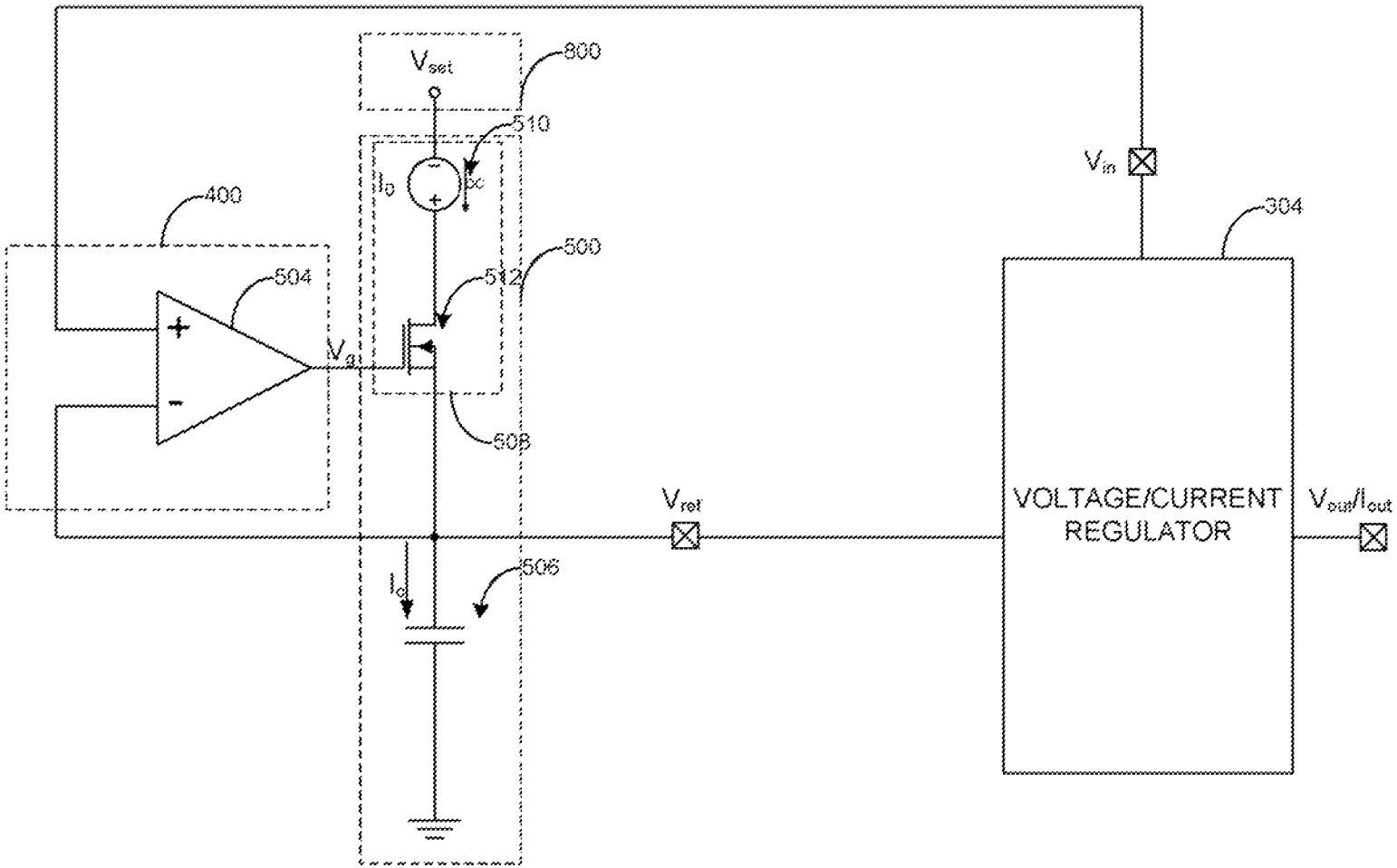
FIG. 8 is a circuit diagram illustrating still another example of an adaptive reference signal generator, in accordance with one embodiment of the present disclosure.
Figure 9:
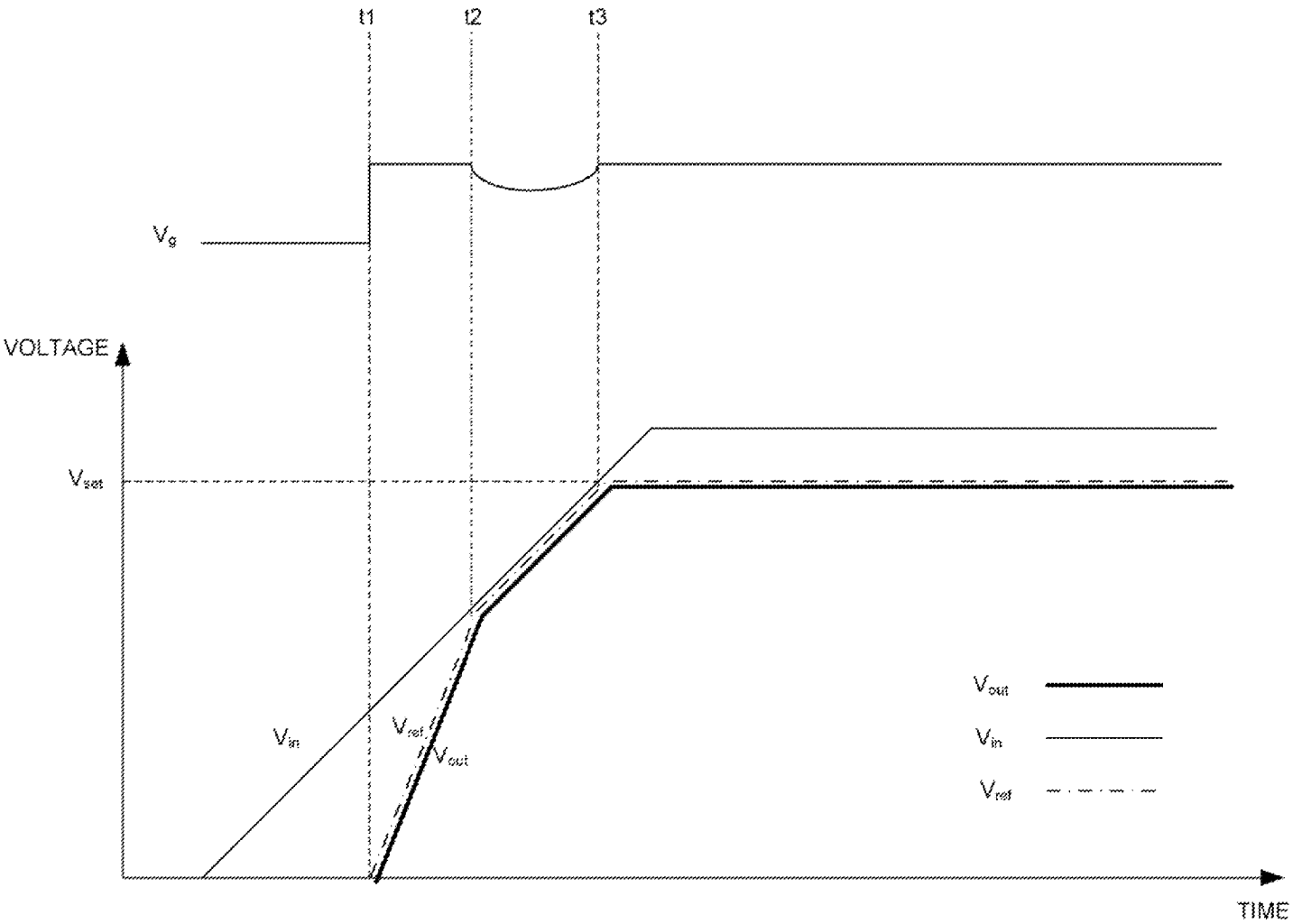
FIG. 9 is a timing diagram for the reference signal, input voltage signal, output signal, and control signal shown in FIG. 8, in accordance with one embodiment of the present disclosure.

FIG. 8 is a circuit diagram illustrating still another example of the adaptive reference signal generator 302 shown in FIG. 4, in accordance with one embodiment of the present disclosure. The adaptive reference signal generator 302 has a similar configuration as what is shown in FIG. 5 except that the second reference signal adjustor 800 does not include a switching module. Instead, in this example, the second reference signal adjustor 800 includes a voltage source setting at the preset level $V_{set}$ operatively coupled to the charging controller 508 such that a maximum voltage level at the capacitor 506 is the preset level $V_{set}$ when the capacitor 506 is fully charged. Referring now to the timing diagram in FIG. 9, from time t1 to time t2, as the input voltage signal $V_{in}$ has a higher level than that of the reference signal $V_{ref}$, the control signal $V_g$ (gate voltage of the transistor 512) of the comparison circuit 400 is at logic high. As the level of the reference signal $V_{ref}$ approaches the preset voltage level $V_{set}$, the control signal $V_g$ decreases and adaptively adjusts the gate voltage of the transistor 512 such that the level of the reference signal $V_{ref}$ does not exceed the input voltage signal $V_{in}$. When the level of the input voltage signal $V_{in}$ exceeds the preset voltage $V_{set}$, the control signal $V_g$ and the gate voltage of the transistor 512 return back to logic high, and the constant current signal $I_0$ continues charging the capacitor 506 to increase the level of the reference signal $V_{ref}$ toward the preset voltage $V_{set}$ set by the second reference signal adjustor 800. In the steady-state phase, the level of the reference signal $V_{ref}$ is maintained at the preset level $V_{set}$ by the second reference signal adjustor 800. It is understood that the second reference signal adjustor 800 in this example may replace the second reference signal adjustor 502 in FIG. 7 to form a different example of the adaptive reference signal generator 302.

Figure 10:
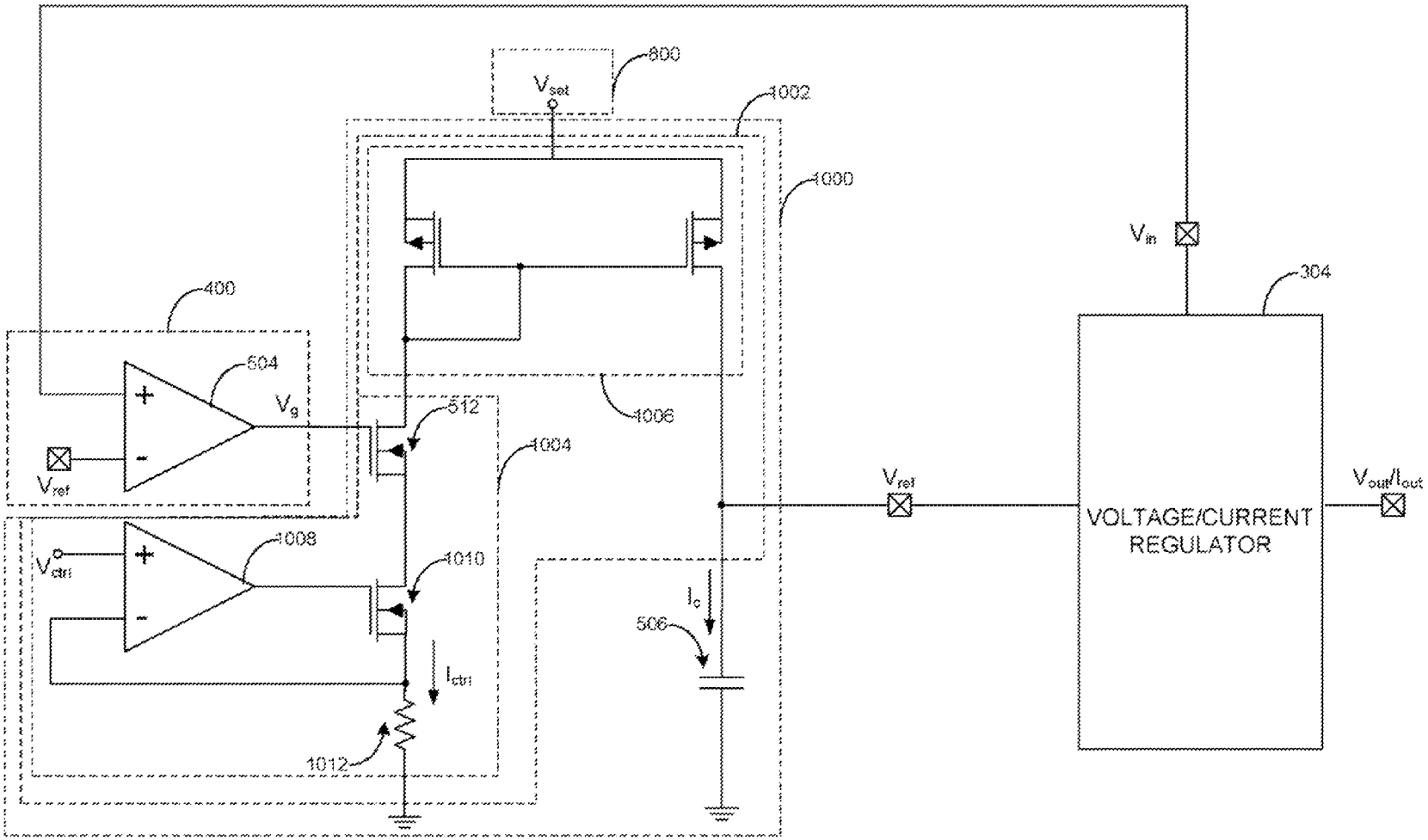
FIG. 10 is a circuit diagram illustrating yet another example of an adaptive reference signal generator, in accordance with one embodiment of the present disclosure.

FIG. 10 is a circuit diagram illustrating yet another example of the adaptive reference signal generator 302 shown in FIG. 4, in accordance with one embodiment of the present disclosure. The adaptive reference signal generator 302 has a similar configuration as what is shown in FIG. 8 except that the first reference signal adjustor 1000 in this example includes a charging controller 1002 that directly modulates a charging current source instead of adding a switch between the current source 510 and the capacitor 506, as shown in FIGS. 5, 7, and 8. In this example, the charging controller 1002 includes a current controller 1004 and a current mirror 1006 operatively coupled to each other. The current controller 1004 is operatively coupled to the comparison circuit 400 to receive the control signal $V_g$ from the error amplifier 504. The current controller 1004 is configured to provide a control current signal $I_{ctrl}$ at an initial level if the level of the reference signal $V_{ref}$ does not exceed the level of the input voltage signal $V_{in}$ at the non-inverting node of the error amplifier 504 and is configured to adjust a level of the control current signal $I_{ctrl}$ based on the difference between the levels of the reference signal $V_{ref}$ and the input voltage signal $V_{in}$ if the level of the reference signal $V_{ref}$ exceeds the level of the input voltage signal $V_{in}$.

In one example, the current controller 1004 includes a current source, which has an amplifier 1008, a transistor 1010, and a resistor 1012, configured to determine the initial level of the control current signal $I_{ctrl}$ based on a control voltage signal $V_{ctrl}$. The initial level of the control current signal $I_{ctrl}$ may be determined by $$I_{ctrl} = \frac{V_{ctrl}}{R},$$

where R is the resistance of the resistor 1012. The selection of $V_{ctrl}$ and R is arbitrary and may be programmed depending on the design requirement of the initial slew-rate of the reference signal $V_{ref}$. The current controller 1004 also includes the transistor 512 configured to switch between the saturation mode and linear mode for adjusting the level of the control current signal $I_{ctrl}$ based on the difference between the levels of the reference signal $V_{ref}$ and the input voltage signal $V_{in}$, as noted above. The current mirror 1006 is then responsible for generating a charging current signal $I_c$ at a level substantially equal to the level of the control current signal $I_{ctrl}$. That is, the initial control current signal $I_{ctrl}$ flows through the transistor 512, which is adjusted accordingly by the feedback control loop, and is mirrored by the current mirror 1006 to charge the capacitor 506. The initial slew-rate of the reference signal $V_{ref}$ before it is adjusted by the transistor 512 is determined by $$\frac{dV_{ref}}{dt} = \frac{V_{ctrl}}{RC},$$

where C is the capacitance of the capacitor 506. It is understood that the first reference signal adjustor 1000 in this example may replace the first reference signal adjustors 500, 700 in FIGS. 5, 7, and 8, respectively, to form different examples of the adaptive reference signal generator 302. Also, the second reference signal adjustor 800 in this example may be replaced with the second reference signal adjustor 502 in FIG. 5 to form another example of the adaptive reference signal generator 302.

Figure 11:
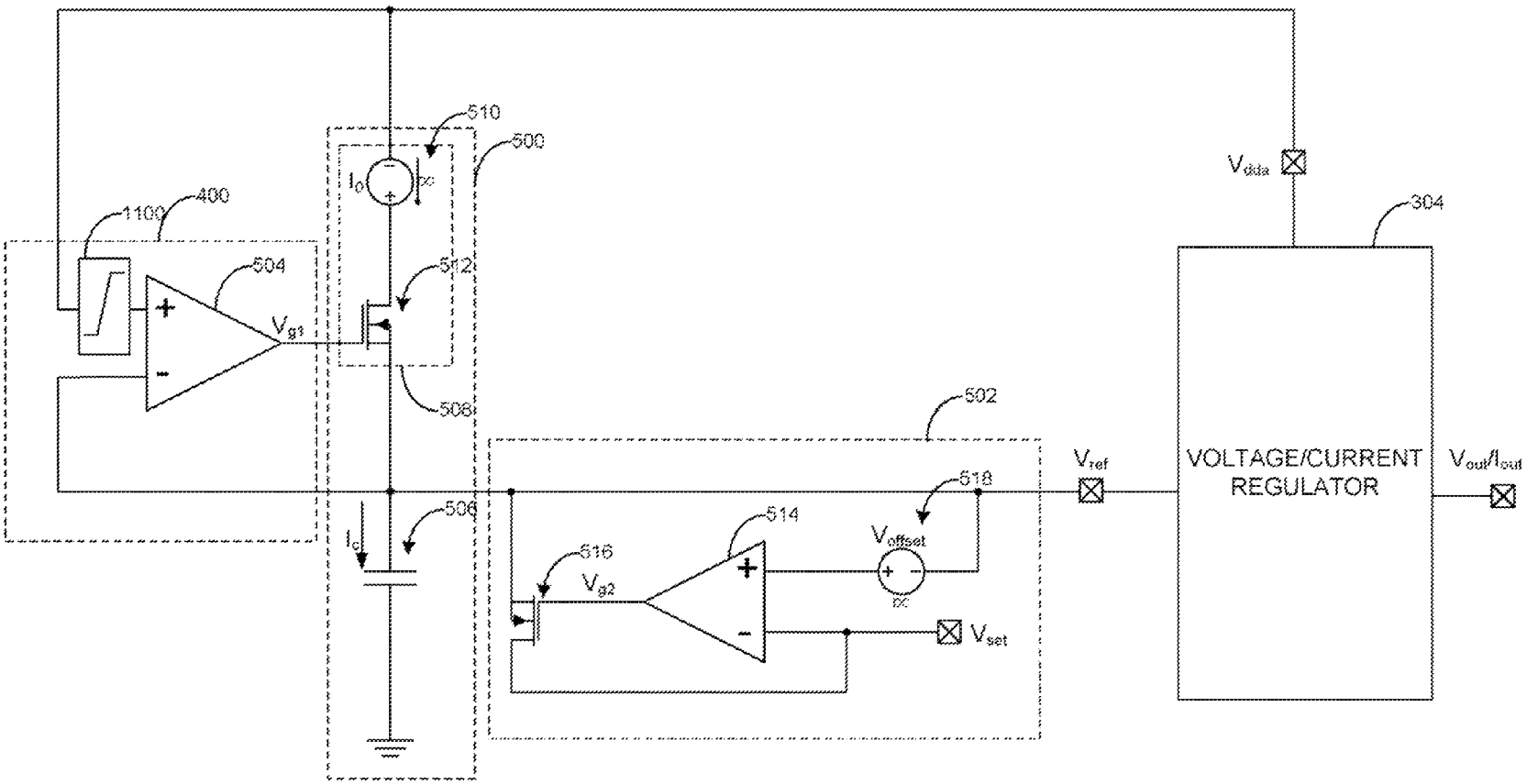
FIG. 11 is a circuit diagram illustrating yet another example of an adaptive reference signal generator, in accordance with one embodiment of the present disclosure.

FIG. 11 is a circuit diagram illustrating yet another example of the adaptive reference signal generator 302 shown in FIG. 4, in accordance with one embodiment of the present disclosure. The adaptive reference signal generator 302 has a similar configuration as what is shown in FIG. 5 except that the comparison circuit 400 further includes a constraint signal adjustor 1100 operatively coupled to the non-inverting node of the error amplifier 504. In one example, the constraint signal adjustor 1100 includes any suitable level shifter or divider as known in the art. In this example, the constraint signal is the supply voltage signal $V_{dda}$ whose level is adjusted based on the headroom requirement of the feedback control loop of the regulator 304. The "headroom" referred herein may be the voltage difference between the regulated output voltage $V_{out}$ and the supply voltage signal $V_{dda}$ where the feedback control loop is able to operate properly. For example, the level of the supply voltage signal $V_{dda}$ may be level-shifted (e.g., subtracted by a shift voltage) or scaled-down (e.g., multiplied by a fraction) from the regulator 304 to the non-inverting node of the error amplifier 504 by the constraint signal adjustor 1100 considering the insufficient headroom of the feedback control loop. In one example, the headroom requirement may be that the supply voltage signal $V_{dda}$ applied to the error amplifier of the regulator 304 is no less than the output voltage $V_{out}$ plus a headroom voltage $V_{headroom}$, which is the drain-source voltage $V_{ds}$ of the PMOS transistor at the output stage of the error amplifier of the regulator 304 plus the gate voltage $V_g$ of the pass element of the regulator 304, i.e., $V_{headroom}=V_{ds}+V_g$. In this case, the constraint signal adjustor 1100 shifts the supply voltage signal $V_{dds}$ by the level of headroom voltage $V_{headroom}$. It is understood that, however, in another example, the native supply voltage signal $V_{dda}$ may be compared with the reference signal $V_{ref}$ directly without the need of the constraint signal adjustor 1100, for example, when the error amplifier of the regulator 304 has a rail-to-rail design. It is also understood that the constraint signal adjustor 1100 may also be applied to the examples in FIGS. 5, 7, 8, and 10, where the constraint signal is the input voltage signal $V_{in}$. such that an adjusted input voltage signal $V_{in}$ may be compared with the reference signal $V_{ref}$ if necessary.

Figure 12:
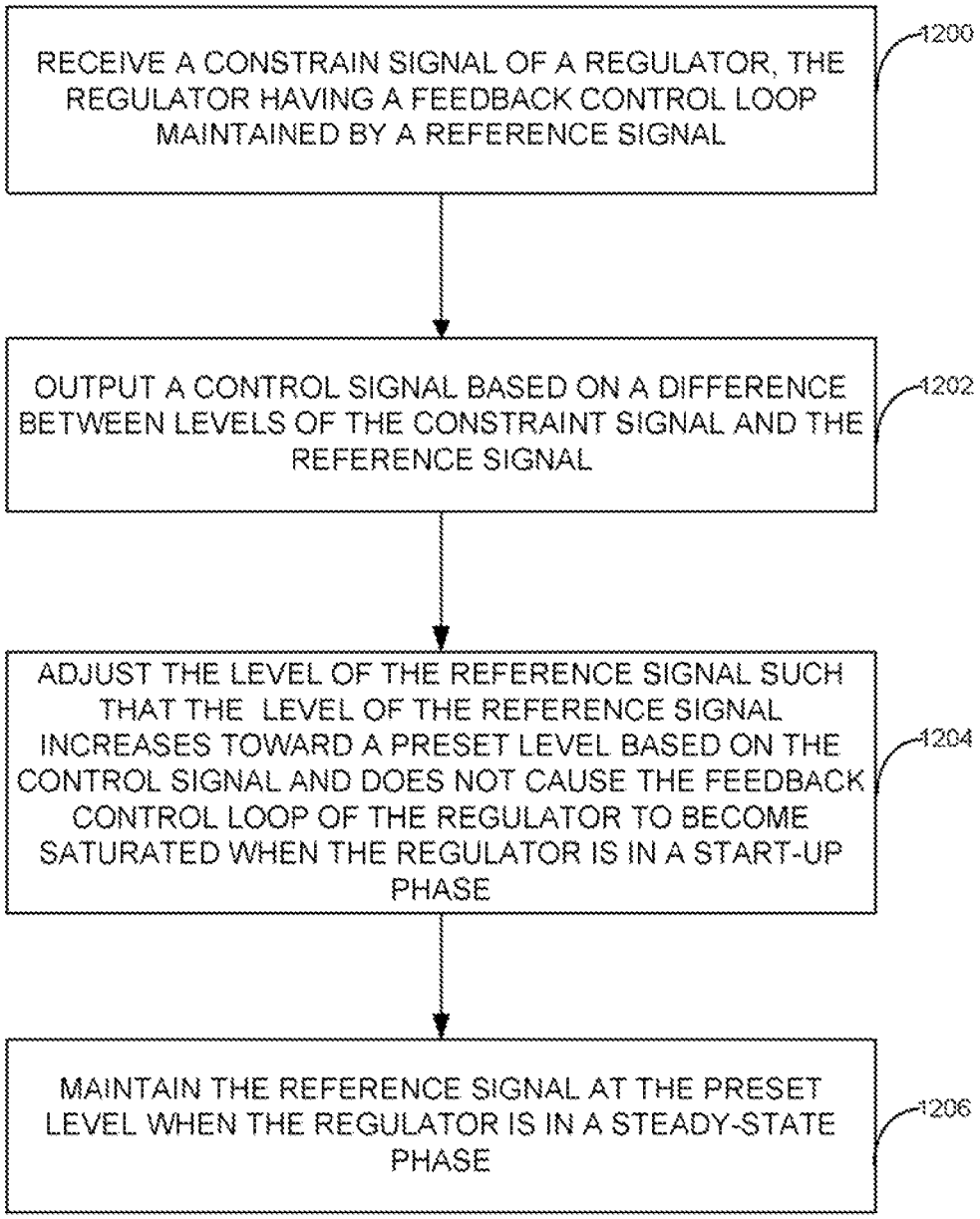
FIG. 12 is a flow chart illustrating a method for providing a reference signal to a regulator, in accordance with one embodiment of the present disclosure.

FIG. 12 depicts one example of a method for providing a reference signal to a regulator. Beginning at block 1200, a constraint signal of a regulator 304 is received. The constraint signal may be an input voltage signal or a supply voltage signal. The regulator 304 may be a voltage regulator or a current regulator that has a feedback control loop maintained by a reference signal. At block 1202, a control signal is outputted based on a difference between levels of the constraint signal and the reference signal. As described above, blocks 1200, 1202 may be performed by the comparison circuit 400 of the adaptive reference signal generator 302. Proceeding to block 1204, the level of the reference signal is adjusted based on the control signal such that the level of the reference signal increases toward a preset level and does not cause the feedback control loop of the regulator 304 to become saturated when the regulator 304 is in a start-up phase. As described above, block 1204 may be performed by the first reference signal adjustor 402 of the adaptive reference signal generator 302. Additionally or optionally, at block 1206, the reference signal is maintained at the preset level when the regulator 304 is in a steady-state phase. As described above, block 1206 may be performed by the second reference signal adjustor 404 of the adaptive reference signal generator 302.

Also, integrated circuit design systems (e.g., work stations) are known that create wafers with integrated circuits based on executable instructions stored on a computer readable medium such as but not limited to CDROM, RAM, other forms of ROM, hard drives, distributed memory, etc. The instructions may be represented by any suitable language such as but not limited to hardware descriptor language (HDL), Verilog or other suitable language. As such, the circuits described herein may also be produced as integrated circuits by such systems using the computer readable medium with instructions stored therein. For example, an integrated circuit with the aforedescribed circuits may be created using such integrated circuit fabrication systems. The computer readable medium stores instructions executable by one or more integrated circuit design systems that causes the one or more integrated circuit design systems to design an integrated circuit. The designed integrated circuit includes a comparison circuit, a first reference signal adjustor, as well as other circuits as disclosed herein. The comparison circuit is configured to output a control signal based on a difference between levels of a constraint signal of a regulator and a reference signal. The regulator has a feedback control loop maintained by a reference signal. The first reference signal adjustor is operatively coupled to the comparison circuit and is configured to adjust the level of the reference signal based on the control signal such that the level of the reference signal increases toward a preset level and does not cause the feedback control loop of the regulator to become saturated when the regulator is in a start-up phase.

While the foregoing description and drawings represent embodiments of the present disclosure, it will be understood that various additions, modifications, and substitutions may be made therein without departing from the spirit and scope of the principles of the present disclosure as defined in the accompanying claims. One skilled in the art will appreciate that the present disclosure may be used with many modifications of form, structure, arrangement, proportions, materials, elements, and components and otherwise, used in the practice of the disclosure, which are particularly adapted to specific environments and operative requirements without departing from the principles of the present disclosure. The presently disclosed embodiments are therefore to be considered in all respects as illustrative and not restrictive, the scope of the present disclosure being indicated by the appended claims and their legal equivalents, and not limited to the foregoing description.

What is claimed is:

1. An integrated circuit for providing a reference signal to a regulator, comprising:

a comparison circuit configured to output a control signal based on a difference between levels of a constraint signal of the regulator and the reference signal, the regulator having a feedback control loop maintained by the reference signal;

a first reference signal adjustor operatively coupled to the comparison circuit, configured to adjust the level of the reference signal based on the control signal such that the level of the reference signal increases toward a preset level and does not cause the feedback control loop of the regulator to become saturated when the regulator is in a start-up phase; and a second reference signal adjustor operatively coupled to the first reference signal adjustor, configured to maintain the reference signal at the preset level when the regulator is in a steady-state phase.

2. The integrated circuit of claim 1, wherein the first reference signal adjustor comprises:

a capacitor configured to provide the reference signal at one end thereof; and a charging controller operatively coupled to the capacitor, configured to control a slew-rate of the reference signal by adjusting charging of the capacitor based on the control signal from the comparison circuit.

3. The integrated circuit of claim 2, wherein the charging controller comprises:

a current source configured to generate a constant current signal; and a transistor operatively coupled to the comparison circuit, the current source, and the capacitor, configured to:

operate in a linear mode such that a level of a charging current signal applied to the capacitor is substantially equal to a level of the constant current signal if the level of the reference signal does not exceed the level of the constraint signal, and operate in a saturation mode such that the level of the charging current signal applied to the capacitor is adjusted based on the difference between the levels of the reference signal and the constraint signal if the level of the reference signal exceeds the level of the constraint signal.

4. The integrated circuit of claim 2, wherein the charging controller comprises:

a current controller operatively coupled to the comparison circuit, configured to:

provide a control current signal at an initial level if the level of the reference signal does not exceed the level of the constraint signal, and adjust a level of the control current signal based on the difference between the levels of the reference signal and the constraint signal if the level of the reference signal exceeds the level of the constraint signal; and a current mirror operatively coupled to the current controller and the capacitor, configured to generate a charging current signal at a level substantially equal to the level of the control current signal.

5. The integrated circuit of claim 4, wherein the current controller comprises:

a current source comprising an amplifier, a first transistor, and a resistor, the current source configured to determine the initial level of the control current signal based on a control voltage signal; and a second transistor operatively coupled to the current source, configured to switch between a saturation mode and a linear mode for adjusting the level of the control current signal based on the difference between the levels of the reference signal and the constraint signal.

6. The integrated circuit of claim 1, wherein the constraint signal includes an input voltage signal of the regulator; and the level of the reference signal is adjusted based on the control signal such that the level of the reference signal does not exceed the level of the input voltage signal.

7. The integrated circuit of claim 1, wherein the constraint signal includes a supply voltage signal of the regulator whose level is adjusted based on a headroom requirement of the feedback control loop of the regulator; and the level of the reference signal is adjusted based on the control signal such that the level of the reference signal does not exceed the adjusted level of the supply voltage signal.

8. The integrated circuit of claim 1, wherein the second reference signal adjustor comprises a switching module configured to turn off the first reference signal adjustor when the level of the reference signal is within an offset range from the preset level.

9. The integrated circuit of claim 2, wherein the second reference signal adjustor comprises a voltage source at the preset level operatively coupled to the charging controller such that a maximum voltage level at the capacitor is the preset level when the capacitor is fully charged.

10. An apparatus comprising:

a regulator configured to provide an output signal and regulate the output signal at a certain level, the regulator having a feedback control loop maintained by a reference signal;

a circuit operatively coupled to the regulator, configured to receive the output signal and perform one or more functions based on the output signal at the certain level;

a power source operatively coupled to the regulator, configured to provide a constraint signal to the regulator; and an adaptive reference signal generator operatively coupled to the regulator, configured to generate the reference signal based on the constraint signal, the adaptive reference signal generator comprising:

a comparison circuit configured to output a control signal based on a difference between levels of the constraint signal and the reference signal, a first reference signal adjustor operatively coupled to the comparison circuit, configured to adjust the level of the reference signal based on the control signal such that the level of the reference signal increases toward a preset level and does not cause the feedback control loop of the regulator to become saturated when the regulator is in a start-up phase, and a second reference signal adjustor operatively coupled to first reference signal adjustor, configured to maintain the reference signal at the preset level when the regulator is in a steady-state phase.

11. The apparatus of claim 10, wherein the first reference signal adjustor comprises:

a capacitor configured to provide the reference signal at one end thereof; and a charging controller operatively coupled to the capacitor, configured to control a slew-rate of the reference signal by adjusting charging of the capacitor based on the control signal from the comparison circuit.

12. The apparatus of claim 10, wherein the constraint signal includes an input voltage signal of the regulator; and the level of the reference signal is adjusted based on the control signal such that the level of the reference signal does not exceed the level of the input voltage signal.

13. The apparatus of claim 10, wherein the constraint signal includes a supply voltage signal of the regulator whose level is adjusted based on a headroom requirement of the feedback control loop of the regulator; and the level of the reference signal is adjusted based on the control signal such that the level of the reference signal does not exceed the adjusted level of the supply voltage signal.

14. The apparatus of claim 10, wherein the regulator is one of a voltage regulator or a current regulator;

the circuit is a processor; and the power source is a battery.

15. A method for providing a reference signal to a regulator comprising:

receiving a constraint signal of the regulator, the regulator having a feedback control loop maintained by the reference signal;

outputting a control signal based on a difference between levels of the reference signal and the constraint signal;

adjusting charging of a capacitive component based on the control signal to provide the reference signal at one end of the capacitive component;

controlling a slew-rate of the reference signal based on the adjusting of the charging of the capacitive component;

adjusting the level of the reference signal based on the controlling of the slew-rate of the reference signal such that the level of the reference signal increases toward a preset level and does not cause the feedback control loop of the regulator to become saturated when the regulator is in a start-up phase; and maintaining the reference signal at the preset level when the regulator is in a steady-state phase.

16. The method of claim 15, wherein the constraint signal includes an input voltage signal of the regulator; and the level of the reference signal is adjusted based on the control signal such that the level of the reference signal does not exceed the level of the input voltage signal.

17. The method of claim 15, wherein the constraint signal includes a supply voltage signal of the regulator whose level is adjusted based on a headroom requirement of the feedback control loop of the regulator; and the level of the reference signal is adjusted based on the control signal such that the level of the reference signal does not exceed the adjusted level of the supply voltage signal.

18. A computer readable medium storing instructions executable by one or more integrated circuit design systems that causes the one or more integrated circuit design systems to design an integrated circuit comprising:

a comparison circuit configured to output a control signal based on a difference between levels of a constraint signal and a reference signal of a regulator, the regulator having a feedback control loop maintained by the reference signal;

a first reference signal adjustor operatively coupled to the comparison circuit, configured to adjust the level of the reference signal based on the control signal such that the level of the reference signal increases toward a preset level and does not cause the feedback control loop of the regulator to become saturated when the regulator is in a start-up phase; and a second reference signal adjustor operatively coupled to the first reference signal adjustor, configured to maintain the reference signal at the preset level when the regulator is in a steady-state phase.

19. The integrated circuit of claim 1, wherein the comparison circuit and the first reference signal adjustor form a feedback control loop such that the level of the reference signal does not increase beyond the level of the constraint signal.

20. The apparatus of claim 10, wherein the comparison circuit and the first reference signal adjustor form a feedback control loop such that the level of the reference signal does not increase beyond the level of the constraint signal.

21. The medium of claim 18, wherein the comparison circuit and the first reference signal adjustor form a feedback control loop such that the level of the reference signal does not increase beyond the level of the constraint signal.

22. An integrated circuit for providing a reference signal to a regulator, comprising:

a comparison circuit configured to output a control signal based on a difference between levels of a constraint signal of the regulator and the reference signal, the regulator having a feedback control loop maintained by the reference signal; and a first reference signal adjustor operatively coupled to the comparison circuit, configured to adjust the level of the reference signal based on the control signal such that the level of the reference signal increases toward a preset level and does not cause the feedback control loop of the regulator to become saturated when the regulator is in a start-up phase, the first reference signal adjustor comprising:

a capacitor configured to provide the reference signal at one end thereof, and a charging controller operatively coupled to the capacitor, configured to control a slew-rate of the reference signal by adjusting charging of the capacitor based on the control signal from the comparison circuit, the charging controller comprising:

a current source configured to generate a constant current signal, and a transistor operatively coupled to the comparison circuit, the current source, and the capacitor, configured to:

operate in a linear mode such that a level of a charging current signal applied to the capacitor is substantially equal to a level of the constant current signal if the level of the reference signal does not exceed the level of the constraint signal, and operate in a saturation mode such that the level of the charging current signal applied to the capacitor is adjusted based on the difference between the levels of the reference signal and the constraint signal if the level of the reference signal exceeds the level of the constraint signal.

23. An integrated circuit for providing a reference signal to a regulator, comprising:

a comparison circuit configured to output a control signal based on a difference between levels of a constraint signal of the regulator and the reference signal, the regulator having a feedback control loop maintained by the reference signal; and a first reference signal adjustor operatively coupled to the comparison circuit, configured to adjust the level of the reference signal based on the control signal such that the level of the reference signal increases toward a preset level and does not cause the feedback control loop of the regulator to become saturated when the regulator is in a start-up phase, the first reference signal adjustor comprising:

a capacitor configured to provide the reference signal at one end thereof, and a charging controller operatively coupled to the capacitor, configured to control a slew-rate of the reference signal by adjusting charging of the capacitor based on the control signal from the comparison circuit, the charging controller comprising:

a current controller operatively coupled to the comparison circuit, configured to:

provide a control current signal at an initial level if the level of the reference signal does not exceed the level of the constraint signal, and adjust a level of the control current signal based on the difference between the levels of the reference signal and the constraint signal if the level of the reference signal exceeds the level of the constraint signal, and a current mirror operatively coupled to the current controller and the capacitor, configured to generate a charging current signal at a level substantially equal to the level of the control current signal.

* * * * *